US009326344B2

(12) United States Patent
Malyna et al.

(10) Patent No.: US 9,326,344 B2
(45) Date of Patent: Apr. 26, 2016

(54) LED LIGHT SOURCE WITH TRAILING EDGE PHASE CUT DIMMING

(71) Applicant: Koninklijke Philips N.V., Eindhoven (NL)

(72) Inventors: Dmytro Viktorovych Malyna, Eindhoven (NL); Patrick Alouisius Martina De Bruycker, Eindhoven (NL); Harald Josef Gunther Rademacher, Aachen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/372,846

(22) PCT Filed: Jan. 25, 2013

(86) PCT No.: PCT/IB2013/050668

§ 371 (c)(1),
(2) Date: Jul. 17, 2014

(87) PCT Pub. No.: WO2013/114260

PCT Pub. Date: Aug. 8, 2013

(65) Prior Publication Data

US 2014/0354165 A1 Dec. 4, 2014

Related U.S. Application Data

(60) Provisional application No. 61/593,919, filed on Feb. 2, 2012.

(51) Int. Cl.
*H05B 33/08* (2006.01)
*H05B 39/09* (2006.01)

(52) U.S. Cl.
CPC ..... *H05B 33/0851* (2013.01); *H05B 33/0815* (2013.01); *H05B 39/09* (2013.01)

(58) Field of Classification Search
CPC ..... H05B 33/0851; H05B 33/0815; H05B 41/34; H05B 33/0803; H05B 39/09
USPC ..... 315/200 R
See application file for complete search history.

(56) References Cited

U.S. PATENT DOCUMENTS

| | | | | |
|---|---|---|---|---|
| 8,829,805 | B2 | 9/2014 | Thompson et al. | |
| 9,018,851 | B1 * | 4/2015 | Melanson et al. | 315/247 |
| 2006/0192502 | A1 | 8/2006 | Brown | |
| 2010/0213859 | A1 | 8/2010 | Shteynberg et al. | |
| 2011/0266968 | A1 | 11/2011 | Bordin | |
| 2011/0309759 | A1 | 12/2011 | Shteynberg | |
| 2012/0049752 | A1 * | 3/2012 | King | H05B 33/0815 315/210 |
| 2012/0242237 | A1 * | 9/2012 | Chen et al. | 315/200 R |
| 2014/0197760 | A1 | 7/2014 | Radermacher | |
| 2014/0239840 | A1 * | 8/2014 | Wang et al. | 315/224 |
| 2014/0354158 | A1 * | 12/2014 | Hiramatsu | H05B 33/0815 315/123 |
| 2014/0354165 | A1 * | 12/2014 | Malyna et al. | 315/200 R |
| 2015/0002040 | A1 * | 1/2015 | Malyna et al. | 315/201 |
| 2015/0022108 | A1 * | 1/2015 | Malyna et al. | 315/200 R |
| 2015/0256091 | A1 * | 9/2015 | Melanson | H02M 5/293 315/200 R |

FOREIGN PATENT DOCUMENTS

| | | | |
|---|---|---|---|
| CN | 101513122 | A | 8/2009 |
| JP | 2006319172 | A | 11/2006 |
| WO | 2010137002 | A1 | 12/2010 |
| WO | 2012137002 | A1 | 12/2010 |
| WO | 2011001327 | A1 | 1/2011 |
| WO | 2011045372 | A1 | 4/2011 |
| WO | 2011061633 | A1 | 5/2011 |

OTHER PUBLICATIONS

"AC-DC Controller for Dimmable LED Lighting" Cypress Semiconductor Corporation, Document No. 001-54879, Revised Oct. 26, 2010.

"Adaptive Chopping Circuit for Retrofit Dimmable LED Driver" IWatt Inc. APEC 2011.

"Compatibility of LED Lamps with Phase-Cut Dimmers", IP.Com, Apr. 22, 2010 IP.com No. IPCOM000195169D.

* cited by examiner

*Primary Examiner* — Dylan White

(57) ABSTRACT

Dimmable LED light source comprising: —a rectifier having rectifier input terminals for connection to respective output terminals of a phase cut dimmer of the trailing edge type, input terminals of the phase cut dimmer being connected to the mains supply, and having a first rectifier output terminal and a second rectifier output terminal, —a bleeder circuit connecting the rectifier output terminals, —a series arrangement comprising a first unidirectional element and first capacitive means connecting the rectifier output terminals, —a converter circuit, having input terminals coupled to respective sides of the first capacitive means and output terminals coupled to a LED load, for generating a current through the LED load, in dependence on a dim signal, out of a voltage present across the capacitive means, —a dim circuit for generating a dim signal as a function of the adjusted phase angle of the phase cut dimmer and for supplying the dim signal to a dim input of the converter circuit, —a series arrangement comprising a switching element and second capacitive means coupled between a terminal between the first unidirectional element and the second output terminal of the rectifier, —a control circuit for controlling the switching element in the conductive state when the voltage between the first and second output terminals of the rectifier drops below a first predetermined reference and for controlling the switching element in the non-conductive state when the voltage across the second capacitive means has reached a second predetermined reference, wherein the first capacitive means is dimensioned so that the voltage between the first and the second output terminal of the rectifier equals the sum of the voltage across the first capacitive means and the voltage across the first unidirectional means if the switching element is non-conductive.

18 Claims, 4 Drawing Sheets

LED LIGHT SOURCE WITH TRAILING EDGE PHASE CUT DIMMING

CROSS-REFERENCE TO PRIOR APPLICATIONS

This application is the U.S. National Phase application under 35 U.S.C. §371 of International Application No. PCT/IB2013/050668, filed on Jan. 25, 2013, which claims the benefit of U.S. Patent Application No. 61/593,919, filed on Feb. 2, 2012. These applications are hereby incorporated by reference herein.

FIELD OF THE INVENTION

The invention relates to a LED light source that is dimmable by means of a trailing edge phase cut dimmer. The invention also relates to a method of dimming a LED light source.

BACKGROUND OF THE INVENTION

A LED light source is known from WO2010137002A1, and is shown together with a phase cut dimmer of the trailing edge type in FIG. 1.

In FIGS. 1, K1 and K2 are input terminals for connection to a supply voltage source supplying an AC supply voltage such as the mains supply. Bi-directional switch S1, snubber capacitor C1 and timing circuitry TC are comprised in a phase cut dimmer of the trailing edge type. Terminals K3 and K4 are input terminals of a rectifier formed by diodes D5-D8. Terminal K4 is connected to input terminal K2. Input terminal K1 is connected to terminal K3 via bidirectional switch S1.

A first output terminal and a second output terminal of the rectifier are connected by a first series arrangement of a resistor R-WB and switch S2 and also by a second series arrangement of a resistor R-SB and switch S3. A control electrode of switch S2 is coupled to an output of comparator COMP1 and a control electrode of switch S3 is coupled to an output terminal of comparator COMP2. A first input terminal of comparator COMP1 and a first input terminal of comparator COMP2 are both connected to the first output voltage Vref1 is present and at a second input terminal of comparator COMP2 a reference voltage Vref2 is present. Resistor R-WB, switch S2 and comparator COMP1 together form a first bleeder and resistor R-SB, switch S3 and comparator COMP2 together form a second bleeder. The first and second output terminals of the rectifier are also connected by means of a series arrangement comprising a diode D9 and a capacitor C2.

The function of the first bleeder is to charge the snubber capacitor C1, when the bidirectional switch S1 has become non-conductive and the diode D9 is blocking. The function of the second bleeder is to charge the power supply of the dimmer (not shown) and reset the timing circuitry comprised in the dimmer.

Respective input terminals of converter CONV are connected to respective sides of capacitor C2. Output terminals of the converter CONV are connected to a LED load LED. Converter CONV is a converter for generating a current through the LED load LED out of a voltage present across capacitor C2.

The first and second output terminals of the rectifier are also connected by a series arrangement of resistors R2 and R3. Resistor R3 is shunted by capacitor C3. Resistors R2 and R3 together with capacitor C3 form a low pass filter for generating a dim signal. The input terminals of the low pass filter are formed by the first and second output terminals of the rectifier and during operation the dim signal is present across the capacitor C3. A common terminal of resistor R2 and capacitor C3 is connected to a dim input terminal of converter CONV, so that the dim signal is supplied to this dim input terminal of the converter. When the mains supply is connected to input terminals K1 and K2, the sinusoidal supply voltage supplied by the mains supply is phase cut by the phase cut dimmer and the phase cut sinusoidal supply voltage is rectified by means of the rectifier.

Since the phase cut dimmer is of the trailing edge kind, during each half period of the AC supply voltage the dimmer switch is first maintained conductive and then switched off at the adjusted phase angle of the phase cut dimmer. The dimmer switch is subsequently maintained in a non-conductive state until the end of the half period.

The rectified phase cut mains supply voltage (when its momentary magnitude is higher than the voltage across the capacitor C2) causes a charging current to flow via diode D9 to capacitor C2. The voltage across the capacitor is used to supply the converter CONV and thus also to supply the LED load LED connected to its output terminals. The converter generates a current through the LED loads.

To ensure a proper operation of the phase cut dimmer, in spite of the fact that the LED light source consumes less current than an incandescent lamp for which the phase cut dimmer was actually designed, the known LED light source is further equipped with the first bleeder and the second bleeder connected between the first and second output terminals of the rectifier. The first bleeder carries a comparatively small current and is switched on when the voltage between the first and second rectifier output terminals is below a first predetermined value (e.g. 200V). The second bleeder carries a higher current and is only switched on when the voltage between the first and second rectifier output terminals drops below a second predetermined value (e.g. 50 V), much lower than the first predetermined value.

The magnitude of the current through the LED load depends on the dim signal that is supplied to the dim input of the converter and thus is a function of the shape of the voltage present between the output terminals of the rectifier and hence also a function of the adjusted phase angle of the phase cut dimmer.

In case the phase cut dimmer were used to dim an incandescent lamp, the dim signal present at the output terminals of the low pass filter would have a different value for each value of the adjusted phase angle of the phase angle dimmer. This is because the voltage between the first and second output terminals of the rectifier would have a steep edge at the adjusted phase angle of the phase angle dimmer (or in other words at the moment the dimmer switch S1 is rendered non-conductive). In the case of the LED light source described hereinabove, however, some undesired effects occur when the phase cut dimmer is of the trailing edge type and the adjusted phase angle is between 90 degrees and the value of the phase angle for which the voltage between the first and second rectifier output terminals equals the first predetermined value (in other words the voltage at which the first bleeder is activated). In this case the capacitor C2 supplying the converter is charged to a voltage that equals the amplitude of the mains supply voltage, when the phase angle is 90 degrees. When the phase angle increases further, no current flows to the capacitor since its voltage is higher than the momentary amplitude of the voltage present between the first output terminal and the second output terminal of the rectifier. Flow of current in the opposite direction is impeded by the diode. Since the impedance of the snubber capacitor C1 comprised in the dimmer is much lower than the input impedance of the LED light source, the voltage between the first and second output terminals of the rectifier follows the shape of the mains voltage until the first bleeder is activated, irrespective of whether the dimmer switch is conductive or not. As a consequence, the dim signal present between the output terminals of the low pass filter is the same for all adjusted phase angle values that lie between 90 degrees and the phase angle at which the first bleeder is activated. This causes a discontinuity in the dimming curve, i.e. the relation between adjusted phase angle and light output of the LED load LED.

Furthermore, when the dimmer switch is made non-conductive after the first bleeder has been activated, the bleeder current causes a slight distortion of the dim signal, resulting in non-linearity of the relation between the adjusted phase angle and the light output of the LED load. Since the phase angle is adjusted by a user it is desirable that the relation between adjusted phase angle of the phase cut dimmer and the light output is free of discontinuities and non-linearities.

In FIG. 2, several voltages in the circuitry shown in FIG. 1 are shown as a function of time. In FIG. 2, switch S1 is made non-conductive 6 msec. after the zero crossing of the mains voltage and the first bleeder is activated after 8 msec. Curve V1 is the mains supply voltage, curve V2 is the voltage across the capacitor C2, V3 is the voltage between the first and second output terminals of the rectifier and curve V4 is the shape of the voltage across the output terminals of the rectifier in case diode D9, capacitor C2, converter CONV and LED load LED were jointly replaced by an incandescent lamp. In curve V4 there is a steep trailing edge when the switch S1 in the phase cut dimmer is made non-conductive. This trailing edge is far steeper than curve V3, because the incandescent lamp draws more current than the LED light source, and hence capacitor C1 is charged quickly.

It can be seen that curve V3 has exactly the same shape as the mains voltage between 5 msec (a phase angle of 90 degrees) and 8 msec, whereas after 8 msec curve V3 is dropping somewhat steeper than the mains supply voltage, but not as steep as curve V4, because the time constant of the RC circuit R_WB*C1 is larger than it would be if the load were an incandescent lamp.

SUMMARY OF THE INVENTION

It is an object of the invention to provide a LED light source that is dimmable by means of a phase cut dimmer of the trailing edge kind while discontinuity and non-linearity in the relation between the adjusted phase angle and the light output are avoided. According to a first aspect of the invention, a dimmable LED light source is provided comprising:

- a rectifier having rectifier input terminals for connection to respective output terminals of a phase cut dimmer of the trailing edge type and having a first output terminal and a second output terminal, said phase cut dimmer having input terminals for connection to the mains supply,
- a series arrangement comprising a first unidirectional element and first capacitive means connecting the first and second output terminals of the rectifier,
- a converter circuit, having input terminals coupled to respective sides of the first capacitive means and output terminals coupled to a LED load LED, for generating a current through the LED load LED, in dependence on a dim signal, out of a voltage present across the capacitive means,
- a dim circuit for generating a dim signal that is a function of the voltage present between the first output terminal and the second output terminal of the rectifier and for supplying the dim signal to a dim input of the converter circuit,
- a series arrangement comprising a first switch and second capacitive means coupled between the second output terminal of the rectifier and a terminal between the first unidirectional element and the first capacitive means,
- a control circuit for controlling the first switch in the conductive state when the voltage between the first and second output terminals of the rectifier drops below a first predetermined reference and for controlling the first switch in the non-conductive state when the voltage across the second capacitive means has reached a second predetermined reference, wherein the first capacitive means is dimensioned so that the voltage between the first and the second output terminal of the rectifier equals the sum of the voltage across the first capacitive means and the voltage across the first unidirectional means, in case the first switch is non-conductive.

Since the first capacitive means is very small, the voltage between the output terminals of the rectifier drops very steeply after the dimmer switch has been made non-conductive. As a consequence, the dim signal can easily be generated for instance by filtering the voltage between the first and second output terminals of the rectifier by means of a low pass filter. When this dim signal is used, the relation between the adjusted phase angle and the light output does not suffer from discontinuity and non-linearity.

In a first preferred embodiment of a dimmable LED light source according to the invention, the LED light source further comprises a second unidirectional element shunting the first unidirectional element and the first switch. The second capacitor can be charged via this second unidirectional element, when the voltage between the first and the second output terminal of the rectifier is comparatively high.

In another preferred embodiment of a dimmable LED light source according to the invention, the LED light source comprises a bleeder connected between the first output terminal and the second output terminal of the rectifier and comprising a series arrangement of a second switch and an impedance and a switch control circuit, for charging a power supply comprised in the phase cut dimmer and for resetting a timer comprised in the phase cut dimmer.

In this latter preferred embodiment, the dim circuit may comprise circuitry for detecting, in each period of the voltage between the output terminals of the rectifier,

- a first phase angle at which the bleeder is switched off, and
- a second phase angle at which the first switch is made conductive, and circuitry for generating a signal that represents the difference between the second and the first phase angle. An obvious advantage is that the first phase angle and the second phase angle can easily be detected by the switch control circuit comprised in the bleeder and the control circuit for controlling the first switch.

It is noted that the bleeder is switched off at a very low magnitude of the voltage between the first and second output terminals of the rectifier. Therefore, the first phase angle is in fact smaller than the lowest phase angle that can be adjusted in the phase cut dimmer. Since for these small phase angles the voltage between the first and the second output terminal of the rectifier is equal to the rectified mains, the first phase angle has a constant value.

The second phase angle depends on the shape of the voltage between the first and second output terminals of the rectifier, more in particular on the steepness of the trailing edge. As already indicated, this trailing edge is steep because of the small capacity of the first capacitor.

The signal that represents the difference between the second and the first phase angle thus depends on the shape of the voltage between the first and the second output terminal. Preferably, the signal that represents the difference between the second and the first phase angle is a digital signal that is periodical with a period of 180 degrees and that is high during a time lapse equal to the difference between the second and the first phase angle and low in the remainder of the period, and the dim circuit is further equipped with a low pass filter for filtering the digital signal. By filtering the digital signal with the low pass filter, a dim signal is obtained that provides a relation between the adjusted phase angle and the light output, that does not suffer from discontinuity and non-linearity.

According to another aspect, a method of dimming a LED light source is provided comprising the steps of

- providing a phase cut dimmer and using the phase cut dimmer to generate a phase cut sinusoidal supply voltage out of a sinusoidal supply voltage,
- rectifying the phase cut sinusoidal supply voltage, using a rectifier having a first rectifier output terminal and a second rectifier output terminal,
- supplying the rectified phase cut sinusoidal supply voltage to a series arrangement of a unidirectional element and first capacitive means,
- providing a converter circuit having a LED load coupled to its output terminals and generating a current through said LED load out of a voltage across the first capacitive means,
- providing a second capacitive means and charging the second capacitive means when the voltage between the first rectifier output terminal and the second rectifier output terminal is high and discharging the second capacitive means into the first capacitive means when the voltage between the first rectifier output terminal and the second rectifier output terminal is low,
- generating the dim signal as a function of the adjusted phase angle,
- controlling the magnitude of the current through the LED load as a function of the dim signal, and
- controlling the voltage across the first capacitive means so that the sum of the voltages across the first capacitive means and the voltage across the first unidirectional element equals the voltage between the first and the second output terminal of the rectifier, when the second capacitive means is not being discharged.

Also the method according to the invention enables dimming of the LED light source with good linearity and good continuity.

BRIEF DESCRIPTION OF THE DRAWINGS

An embodiment of a prior art LED light source and embodiments of a LED light source according to the invention will be further described with reference to a drawing.

In the drawing.

DESCRIPTION OF EMBODIMENTS

Figure 3:
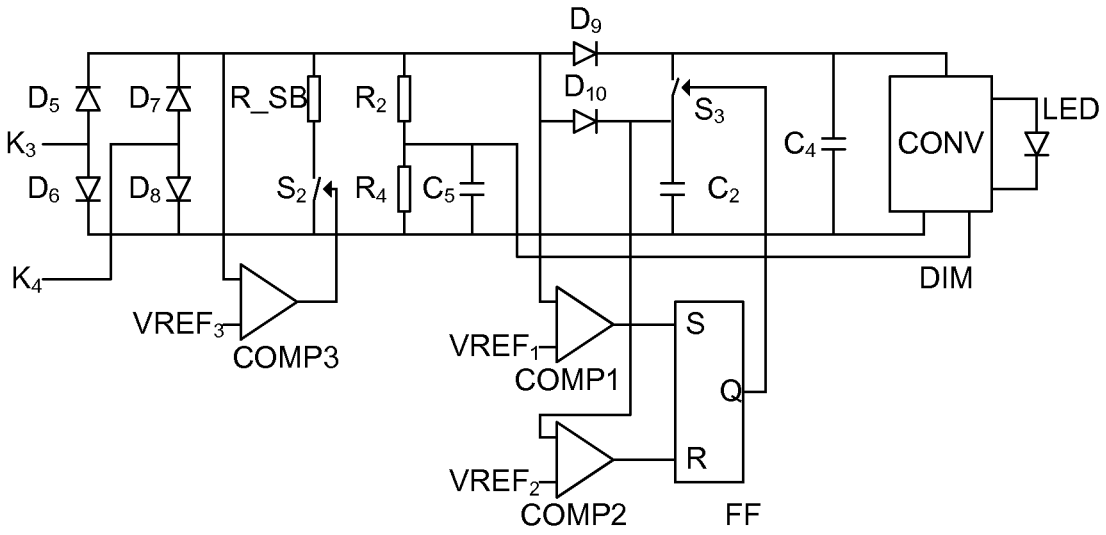
FIG. 3 shows a schematic representation of a first embodiment of a dimmable LED light source according to the invention.

In the LED light source shown in FIGS. 3, K3 and K4 are input terminals suitable for connection to output terminals of a phase cut dimmer of the trailing edge type. Input terminals K3 and K4 are also input terminals of a rectifier formed by diodes D5-D8. First and second output terminals of the rectifier are connected by means of a series arrangement of resistor R-SB and switch S2. Together with control circuitry for controlling the conductive state of the switch S2, resistor R-SB and switch S2 together form a bleeder. The bleeder is activated in the vicinity of zero crossings of the voltage present between the first and second output terminals of the phase cut dimmer (e.g. below 50 V). The function of the bleeder is to charge a power supply of the control circuit of the dimmer switch comprised in the phase cut dimmer and also to reset a timer comprised in the phase cut dimmer.

The first and second output terminals of the rectifier are also connected by a series arrangement of resistors R2 and R4. Resistor R4 is shunted by capacitor C5. Resistors R2 and R4 together with capacitor C5 jointly form a low pass filter. In this embodiment, the low pass filter forms a dim circuit for generating a dim signal as a function of the adjusted phase angle. The different sides of capacitor C5 form output terminals of the low pass filter.

The first and second output terminals of the rectifier are also connected by means of a series arrangement of a diode D9 and a capacitor C4. In this embodiment, diode D9 is the first unidirectional element and capacitor C4 forms first capacitive means in this embodiment.

Capacitor C4 is shunted by a series arrangement of switch S3 and capacitor C2. Switch S3 forms a first switch and capacitor C2 forms second capacitive means in this embodiment. Diode D9 and switch S3 are shunted by a diode D10. Switch S3 is coupled to a control circuit, comprising two comparators COMP1 and COMP2, two reference voltage generators Vref1 and Vref2 and a flip flop FF, for controlling the switch S3 in the conductive state when the voltage between the first and second output terminals of the rectifier drops below a first predetermined reference voltage, generated by the first voltage reference generator Vref1, and for controlling the switching element S3 in the non-conductive state when the voltage across the second capacitive means has reached a second predetermined reference, generated by the second reference voltage generator Vref2. Therefore, a first input terminal of comparator COMP1 is connected to the first output terminal of the rectifier. A first input terminal of comparator COMP2 is connected to a common terminal of capacitor C2 and switch S3. The second input terminals of comparators COMP1 and COMP2 are connected respectively to the first reference voltage generator Vref1 and the second reference voltage generator Vref2. Output terminals of comparators COMP1 and COMP2 are connected to respectively a first input terminal and a second input terminal of flip flop FF. An output of flip flop FF is connected to a control electrode of switch S3.

Capacitor C4 is chosen so small that during operation the sum of the voltage across capacitor C4 and the voltage across diode D9 always equals the voltage between the output terminals of the rectifier, in case the switch S3 is non-conductive.

Respective sides of capacitor C4 are connected to input terminals of a converter circuit CONV. Output terminals of the converter circuit CONV are coupled to a LED load LED, for generating a current through the LED load LED, in dependence on a dim signal and out of a voltage present across capacitor C4. A dim input of the converter circuit CONV is connected to an output terminal of the dim circuit.

The operation of the LED light source shown in FIG. 3 is as follows.

In case input terminals K3 and K4 are connected to output terminals of a phase cut dimmer of the trailing edge type, and input terminals of the phase cut dimmer are connected to an AC supply voltage source such as the mains supply, a rectified phase cut AC supply voltage is present between the output terminals of the rectifier.

Figure 4:
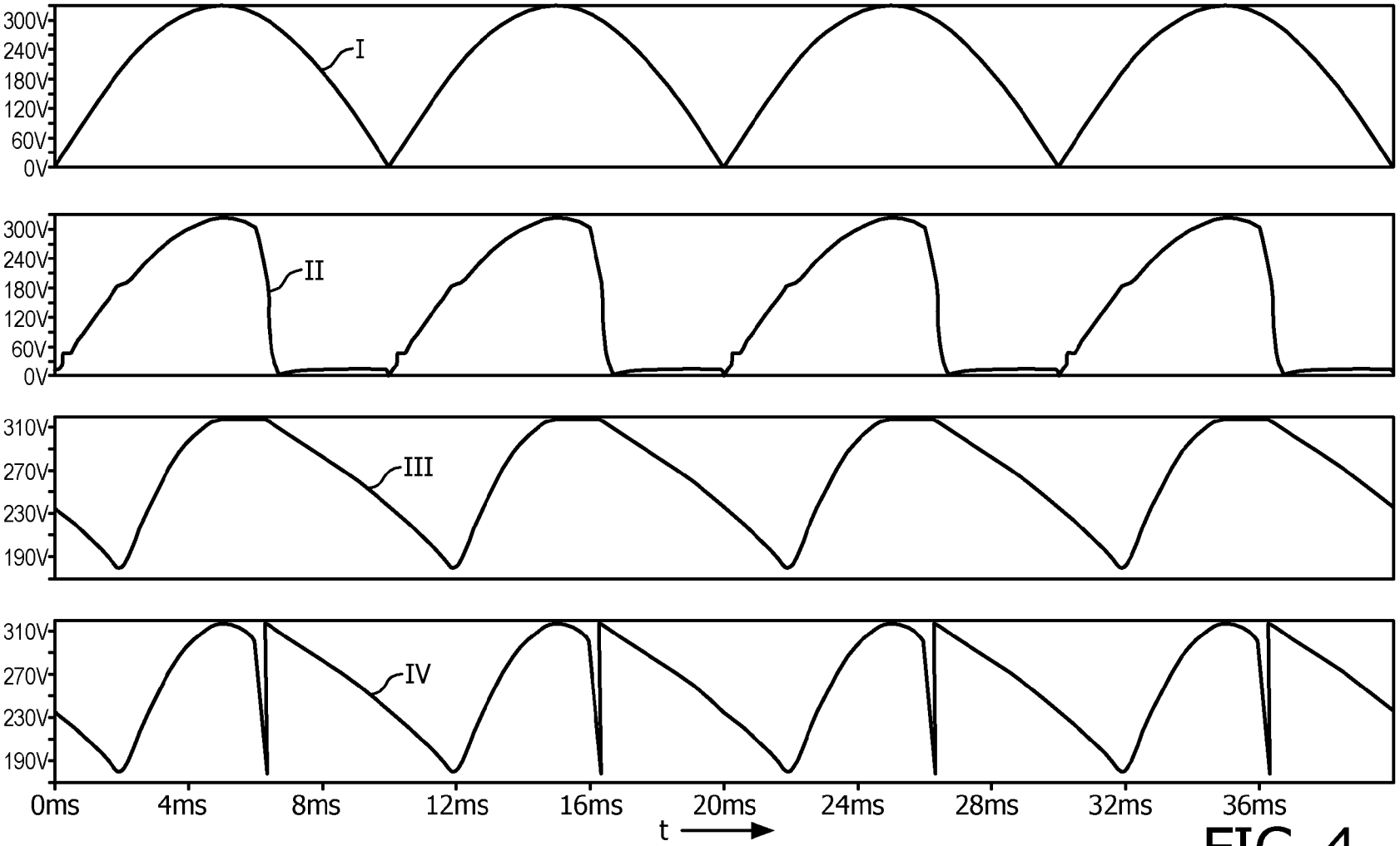
FIG. 4 shows the shape of several voltages at different terminals in the LED light source shown in FIG. 3 during dimmed operation.

In case the adjusted phase angle of the phase cut dimmer is zero, or in other words in case of undimmed operation, the shape of the voltage present between the output terminals of the rectifier is in this case identical to that of curve I in FIG. 4. This voltage supplies capacitor C2 that, in turn, supplies the converter CONV that supplies a current to the LED load so that light is generated by the LED load. Since the phase angle is 180 degrees, the output signal of the low pass filter has a maximal value so that the current generated through the LEDs by the converter CONV is controlled at the highest (undimmed) level.

Figure 1:
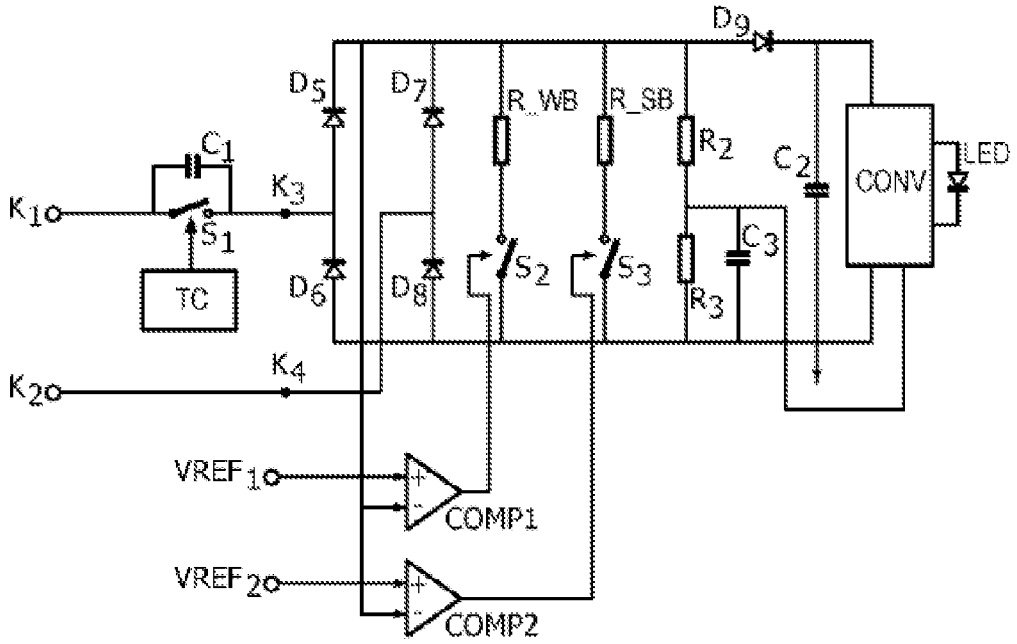
FIG. 1 [PRIOR ART]
FIG. 1 shows a schematic representation of an embodiment of a dimmable LED light source according to the prior art together with a phase cut dimmer of the trailing edge type.
Figure 2:
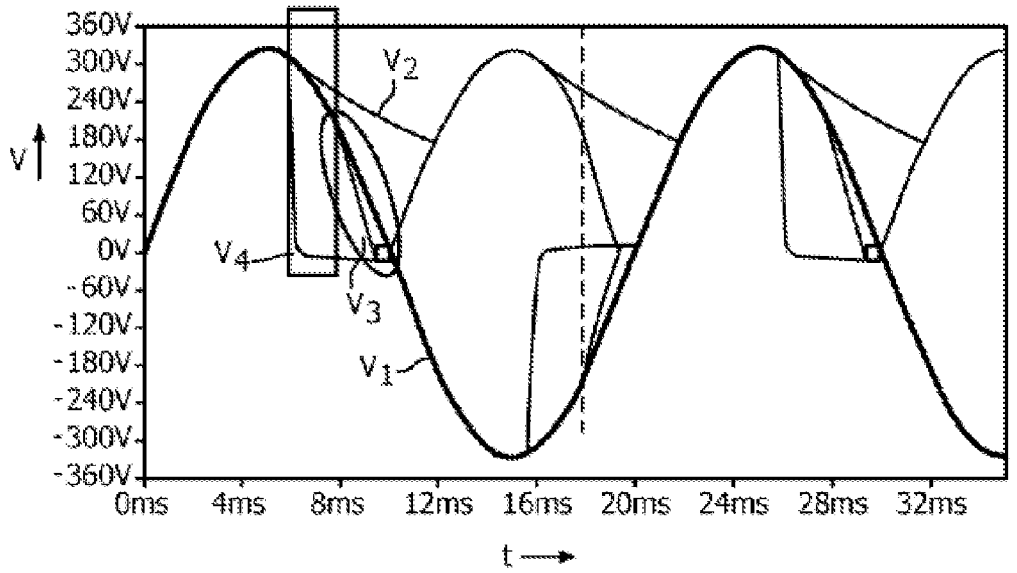
FIG. 2 [PRIOR ART]
FIG. 2 shows the shape of several voltages at different terminals in the LED light source shown in FIG. 1 during dimmed operation.

In case the adjusted phase angle of the phase cut dimmer differs from 180 degrees, the voltage between the output terminals of the rectifier has the shape of curve II in FIG. 4. Since the capacity of capacitor C4 is very low, the voltage between the output terminals of the rectifier drops steeply to zero, when the dimmer switch has been made non-conductive, unlike the shape shown in FIG. 2. Because of the steep trailing edge of the voltage between the output terminals of the rectifier, the use of this dim signal provides a relation between the adjusted phase angle and the LED light output that does not show discontinuity and non-linearity.

However, from the shape of curve II it can be understood that if the voltage between the output terminals of the rectifier were the only voltage supplying capacitor C4, the voltage across capacitor C4 would substantially equal zero during a part of the period of the rectified phase cut supply voltage present between the output terminals of the rectifier, so that the LEDs would carry no current during a time lapse within each half period of the supply voltage.

To prevent this from happening, capacitor C2 is charged via diode D10, when the voltage between the output terminals of the rectifier is high and discharged via switch S3 and capacitor C4, when the voltage between the rectifier output terminals is low. Curve III shows the voltage across capacitor C2 and curve IV shows the voltage across capacitor C4. It can be seen that the voltage across capacitor C4 drops to a value not lower than e.g. 180 Volt, so that the LEDs continuously carry a current, the magnitude of which is determined by the dim signal.

Figure 5:
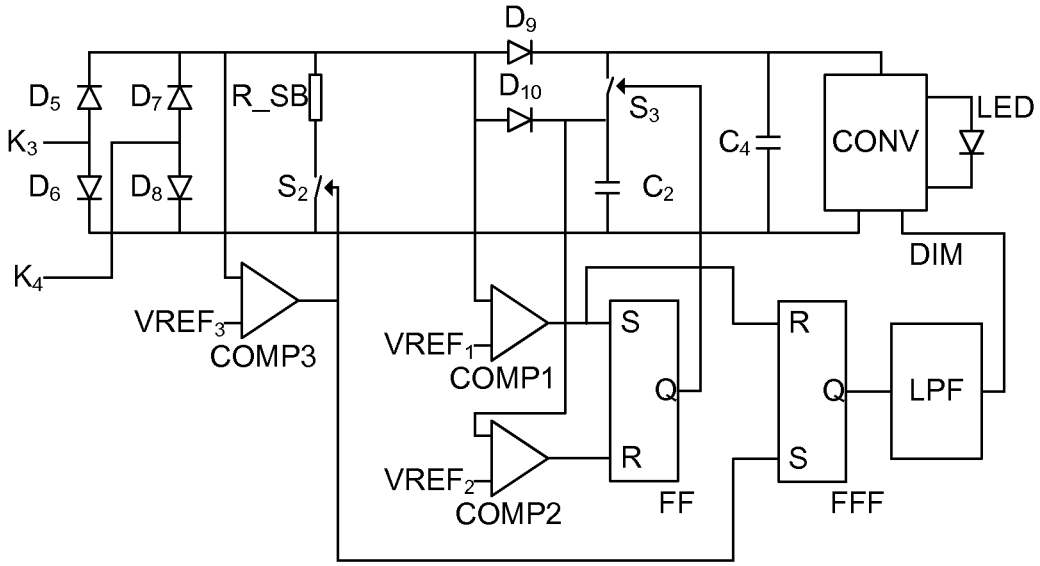
FIG. 5 shows the dim circuit comprised in a second embodiment of a dimmable LED light source according to the invention.

FIG. 5 illustrates an alternative dim circuit for generating a dim signal for use in a further embodiment of a dimmable LED light source. In this further embodiment the low pass filter formed by resistors R2 and R4 and capacitor C5 is dispensed with. In this alternative, a signal is generated that represents the phase angle for which the switch S3 is made conductive minus the phase angle for which the bleeder is switched off, and the dim circuit comprises circuitry for generating this signal as a digital signal with a period of 180 degrees that is high during a time lapse, equal to the phase angle for which the switch S3 is made conductive minus the phase angle for which the bleeder is switched off, and low in the remainder of the period. The dim circuit further comprises a low pass filter for generating the dim signal by filtering the digital signal.

The digital signal can easily be generated partly making use of circuitry already present in the LED light source. As shown in FIG. 5, the alternative dim circuit is formed by comparators COMP1 and COMP3, a further flip flop FFF and a low pass filter LPF. Output terminals of comparators COMP1 and COMP3 are respectively connected to an input R and an input S of the further flip flop FFF. An output terminal of the further flip flop FFF is connected to an input of low pass filter LPF.

Figure 6:
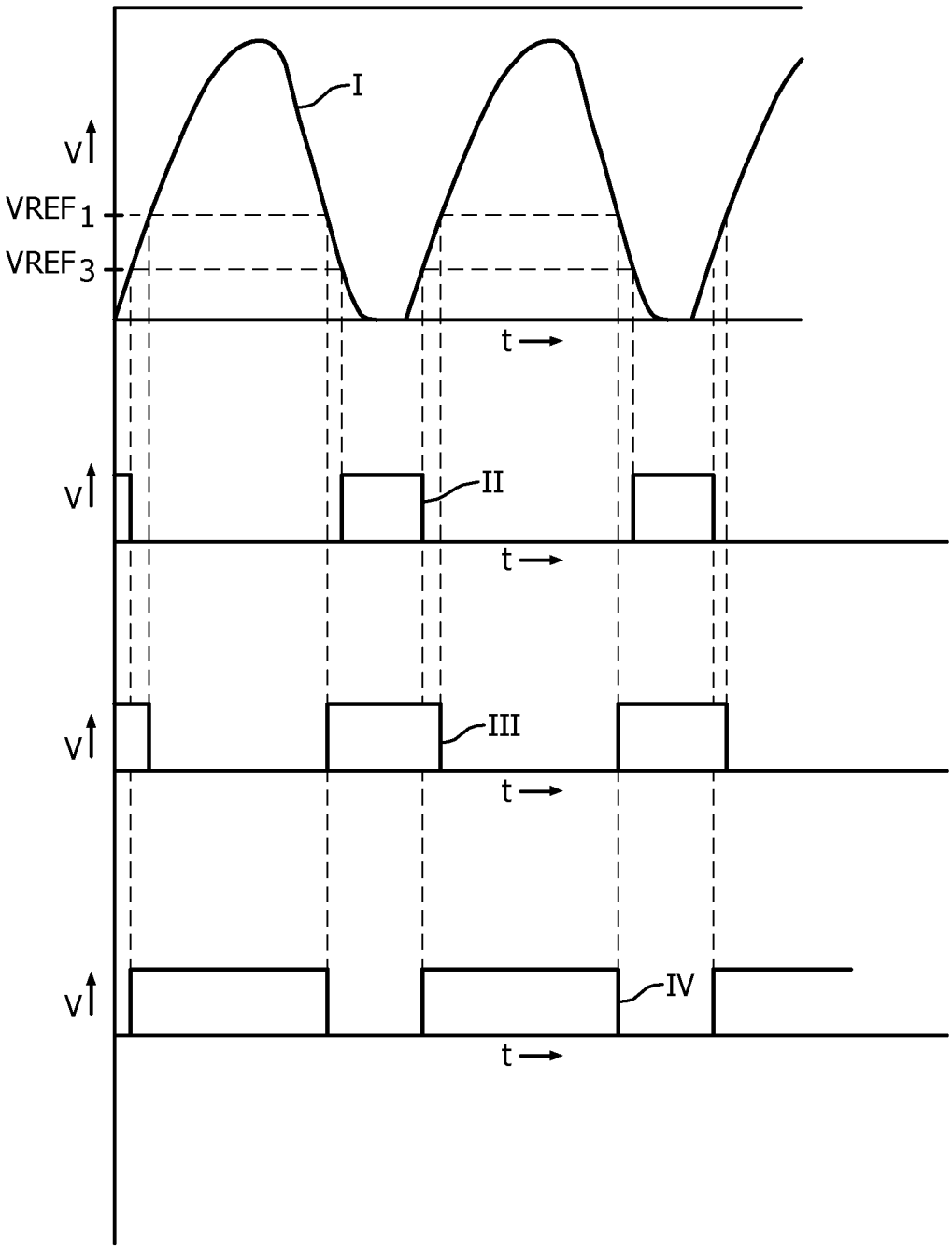
FIG. 6 shows the shape of several voltages present in the dim circuit shown in FIG. 5.

Curve 1 in FIG. 6 is the rectified phase cut AC supply voltage present between the output terminals of the rectifier. Curves II and III respectively show the voltage present at the output terminal of comparator COMP3 and the voltage present at the output terminal of comparator COMP1. Curve IV shows the voltage present at the output terminal Q of the further flip flop FFF.

It can be seen that the voltage at the output of comparator COMP3 is high when the momentary amplitude of the rectified phase cut AC supply voltage is lower than reference voltage Vref3. When this momentary amplitude becomes higher than Vref3, the voltage at the output terminal is low, until the dimmer switch becomes non-conductive so that the momentary amplitude once more drops to a value below Vref3 and the voltage at the output terminal of comparator COMP3 becomes high again until in the next period of the rectified phase cut AC supply voltage the momentary amplitude of the rectified phase cut supply voltage becomes higher than Vref3.

Similarly, the voltage at the output of comparator COMP1 is high when the momentary amplitude of the rectified phase cut AC supply voltage is lower than reference voltage Vref1. When this momentary amplitude becomes higher than Vref1, the voltage at the output terminal is low, until the dimmer switch becomes non-conductive so that the momentary amplitude once more drops to a value below Vref1 and the voltage at the output terminal of comparator COMP1 becomes high again until in the next period of the rectified phase cut AC supply voltage the momentary amplitude of the rectified phase cut supply voltage becomes higher than Vref1.

The voltages present at the output terminals of comparators COMP1 and COMP3 cause a digital signal with the shape of curve IV to be present at the output terminal Q of the further flip flop FFF. This digital signal is filtered by the low pass filter LPF and supplied to the dim input of the converter.

Also for the further embodiment of the dimmable LED light source, it was found that the dimming curve does not suffer from discontinuity and non-linearity.

While the invention has been illustrated and described in detail in the drawings and foregoing description, such illustration and description are to be considered illustrative or exemplary and not restrictive; the invention is not limited to the disclosed embodiments.

Variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage.

The invention claimed is:

1. A dimmable LED light source comprising:

a rectifier having a first rectifier output terminal and a second rectifier output terminal and rectifier input terminals, wherein the rectifier input terminals are connected to dimmer output terminals of a phase cut dimmer of the trailing edge type, said phase cut dimmer having dimmer input terminals for connection to a mains supply, a first unidirectional element and first capacitor connected in series between the first and second rectifier output terminals, a converter circuit having converter input terminals electrically coupled to each terminal of the first capacitor and converter output terminals electrically coupled to a LED load, wherein the converter circuit is configured to generate a current through the LED load, wherein the current is dependent on a dim signal and a voltage present across the first capacitor, a dim circuit that generates the dim signal based on a voltage present between the first and second rectifier output terminals, a first switch and a second capacitor electrically coupled between the second rectifier output terminal and a first connection terminal at a connection between the first unidirectional element and the first capacitor, a control circuit for controlling the first switch in the conductive state when the voltage between the first and second rectifier output terminals drops below a first predetermined reference and for controlling the first switch in the non-conductive state when the voltage across the second capacitor has reached a second predetermined reference.

2. The dimmable LED light source according to claim 1, wherein the LED light source further comprises a second unidirectional element shunted across the first unidirectional element and the first switch.

3. The dimmable LED light source according to claim 1, wherein the phase cut dimmer comprises a power supply and a timer, the dimmable LED light source further comprising:

a bleeder connected between the first rectifier output terminal and the second rectifier output terminal, the bleeder comprising a second switch and an impedance arranged in series; and a switch control circuit arranged to control the bleeder to charge the power supply and to reset the timer.

4. The dimmable LED light source according to claim 1, wherein the dim circuit comprises a low pass filter, the filter comprising a first resistor and a second resistor in series between the first and second rectifier output terminals, and a third capacitor shunting the second resistor.

5. The dimmable LED light source according to claim 1, wherein the dim circuit comprises:

detection circuitry arranged for detecting, in each period of the voltage between the first and second rectifier output terminals, a first phase angle of the voltage at which the bleeder is switched off, and a second phase angle of the voltage at which the switching element is made conductive; and difference circuitry for generating a difference signal that represents the difference between the second and the first phase angle.

6. The dimmable LED light source according to claim 5, wherein the difference signal is a periodic digital signal that is high during a time lapse equal to the difference between the second and the first phase angle and low in the remainder of each period, and wherein the dim circuit is further equipped with a low pass filter for filtering the difference signal.

7. A method of dimming a LED light source comprising the steps of:

using a phase cut dimmer to generate a phase cut sinusoidal supply voltage out of a sinusoidal supply voltage, rectifying the phase cut sinusoidal supply voltage using a rectifier having a first rectifier output terminal and a second rectifier output terminal, supplying the rectified phase cut sinusoidal supply voltage to a series arrangement of a unidirectional element and first capacitor, providing a converter circuit having a LED load coupled to the converter circuit's output terminals and generating a current through said LED load based on a voltage across the first capacitor and a dim signal, charging a second capacitor when a voltage between the first and second rectifier output terminals is high and discharging the second capacitor into the first capacitor when the voltage between the first and second rectifier output terminals is low, and generating the dim signal as a function of the voltage present between the first and second rectifier output terminals.

8. A method according to claim 7, wherein the phase cut dimmer comprises a power supply and a timer, the method further comprising bleeding a current from the first rectifier output terminal to the second rectifier output terminal, for charging the power supply and for resetting the timer.

9. A driver comprising:

a first rectifier output terminal and a second rectifier output terminal that are electrically coupled to a rectifier that provides a voltage to the first and second rectifier output terminals based on outputs of a phase cut dimmer of the trailing edge type, a first unidirectional element and a first capacitor that are electrically coupled in series between the first and second rectifier output terminals, a voltage across the first capacitor being provided to a converter that supplies a current to an LED based on the voltage and a dim signal, and a first switch and a second capacitor that are electrically coupled in series, and electrically coupled in parallel to the first capacitor;

wherein:

the first capacitor has a first capacitance that is substantially smaller than a second capacitance of the second capacitor, and the first switch is configured to provide voltage from the second capacitor to the first capacitor when a voltage between the first and second rectifier output terminals drops below a first reference voltage.

10. The driver of claim 9, including the rectifier.

11. The driver of claim 10, including the phase cut dimmer, the phase cut dimmer including a third capacitor, a second switch, and a timer that controls the second switch to provide at least one of the outputs of a phase cut dimmer.

12. The driver of claim 9, including a low-pass filter electrically coupled to the first and second rectifier output terminals, the low-pass filter providing the dim signal.

13. The driver of claim 9, including a second unidirectional element electrically coupled in parallel to the first unidirectional element and the first switch.

14. The driver of claim 9, including a flip-flop device that controls the first switch to be conductive when the voltage between the first and second rectifier output terminals drops below the first reference voltage.

15. The driver of claim 14, wherein the flip-flop device controls the first switch to be non-conductive when a voltage across the second capacitor drops below a second reference voltage.

16. The driver of claim 14, wherein the flip-flop device controls the first switch to be non-conductive when a voltage across the second capacitor drops below a second reference voltage.

17. The driver of claim 9, including a flip-flop device and a low pass filter that provides the dim signal.

18. The driver of claim 17, wherein the flip-flop device is set when the voltage between the first and second rectifier output terminals rises above a third reference voltage, and reset when the voltage between the first and second rectifier output terminals drops below the first reference voltage.

* * * * *